US007426760B2

(12) United States Patent
Vrzalik

(10) Patent No.: US 7,426,760 B2
(45) Date of Patent: Sep. 23, 2008

(54) BARIATRIC BED APPARATUS AND METHODS

(75) Inventor: John H. Vrzalik, San Antonio, TX (US)

(73) Assignee: KCI Licensing, Inc., San Antonio, TX (US)

( * ) Notice: Subject to any disclaimer, the term of this patent is extended or adjusted under 35 U.S.C. 154(b) by 45 days.

(21) Appl. No.: 11/302,468

(22) Filed: Dec. 12, 2005

(65) Prior Publication Data

US 2006/0090261 A1 May 4, 2006

Related U.S. Application Data

(63) Continuation of application No. 08/904,121, filed on Jul. 31, 1997, now Pat. No. 6,978,501, which is a continuation of application No. 08/767,291, filed on Dec. 16, 1996, now abandoned, which is a continuation-in-part of application No. 08/382,150, filed on Jan. 31, 1995, now abandoned.

(51) Int. Cl.
*A61G 7/02* (2006.01)

(52) U.S. Cl. ..... 5/618; 5/428; 5/425

(58) Field of Classification Search ..... 5/424–428, 5/623–624, 617–619
See application file for complete search history.

(56) References Cited

U.S. PATENT DOCUMENTS

| | | | |
|---|---|---|---|
| 1,772,310 | A | 8/1930 | Hart |
| 2,092,266 | A | 9/1937 | Talas |
| 2,284,470 | A | 5/1942 | Comper et al. |
| 3,065,344 | A | 11/1962 | Chervenka |
| 3,195,151 | A | 7/1965 | Boyer |
| 3,304,116 | A | 2/1967 | Stryker |
| 3,327,328 | A | 6/1967 | Slivoski |
| 3,336,606 | A | 8/1967 | Beitzel |
| 3,344,445 | A | 10/1967 | Crawford |
| 3,426,373 | A | 2/1969 | Scott et al. |
| 3,485,240 | A | 12/1969 | Fountain |
| 3,492,988 | A | 2/1970 | De Mare |
| 3,932,903 | A | 1/1976 | Adams et al. |
| 3,935,604 | A | 2/1976 | Collins |

(Continued)

FOREIGN PATENT DOCUMENTS

| | | |
|---|---|---|
| GB | 183181 | 7/1922 |

(Continued)

OTHER PUBLICATIONS

Burke, Inc., Advertising Material; The Burke Bariatric Treatment System, date unknown.

(Continued)

*Primary Examiner*—Fredrick Conley
*Assistant Examiner*—Patricia Engle

(57) ABSTRACT

A bariatric hospital bed with full feature capability to enhance the care and treatment of bariatric patients. Among the features are fully adjustable and retractable siderails, bed raise-and-lower features, head-up and leg-down features for converting to a seated position, as well as Trendelenburg and reverse-Trendelenburg features. An integral scale assembly and radioluscent capabilities with a built'in X-ray tray are also provided together with redundant, easy-access controls in a pendant as well as in both siderails. An improved footboard is also provided for use as both a foot-rest and a step.

20 Claims, 12 Drawing Sheets

U.S. PATENT DOCUMENTS 4,227,269 A 10/1980 Johnston
4,287,620 A 9/1981 Zur
4,324,010 A 4/1982 Houlberg et al.
4,376,317 A 3/1983 Johnston
4,409,695 A * 10/1983 Johnston et al. ..... 5/601
4,435,862 A 3/1984 King et al.
4,486,908 A 12/1984 Schroeder
4,494,259 A 1/1985 Miller et al.
4,628,556 A 12/1986 Blackman
4,669,136 A 6/1987 Waters et al.
4,745,647 A 5/1988 Goodwin
4,747,171 A * 5/1988 Einsele et al. ..... 5/425
4,769,584 A 9/1988 Irigoyen et al.
4,793,428 A 12/1988 Swersey
4,847,929 A 7/1989 Pupovic
4,858,260 A 8/1989 Failor et al.
4,862,529 A 9/1989 Peck
4,926,457 A 5/1990 Poehner et al.
4,941,221 A 7/1990 Kanzler
4,974,692 A 12/1990 Carruth et al.
4,977,629 A 12/1990 Jones
4,987,623 A 1/1991 Stryker et al.
4,989,283 A 2/1991 Krouskop
5,023,967 A 6/1991 Ferrand
5,044,029 A 9/1991 Vrzalik
5,077,843 A 1/1992 Foster et al.
5,083,332 A 1/1992 Foster et al.
5,090,077 A 2/1992 Caden et al.
5,092,007 A 3/1992 Hasty
5,131,105 A 7/1992 Harrawood et al.
5,148,562 A 9/1992 Borders et al.
5,157,787 A 10/1992 Donnellan et al.
5,166,968 A 11/1992 Morse
5,179,744 A 1/1993 Foster et al.
5,205,004 A 4/1993 Hayes et al.
5,257,428 A 11/1993 Carroll et al.
5,279,010 A 1/1994 Ferrand et al.
5,295,276 A 3/1994 Richards et al.
5,295,430 A 3/1994 Dewald, Jr. et al.
5,317,769 A 6/1994 Weismiller et al.
5,377,370 A 1/1995 Foster et al.
5,393,938 A 2/1995 Bumbalough
5,394,577 A 3/1995 James et al.
5,454,126 A 10/1995 Foster et al.
5,487,196 A 1/1996 Wilkinson et al.
5,542,136 A 8/1996 Tappel
5,542,138 A 8/1996 Williams et al.
5,560,374 A 10/1996 Viard
5,586,346 A 12/1996 Stacy et al.
5,608,932 A 3/1997 Hasegawa
5,611,096 A 3/1997 Bartlett et al.
5,630,238 A 5/1997 Weismiller et al.
5,647,079 A 7/1997 Hakamiun et al.
5,720,059 A 2/1998 Allevato et al.
5,732,423 A 3/1998 Weismiller et al.
5,745,937 A 5/1998 Weismiller et al.
5,771,511 A 6/1998 Kummer et al.
5,862,551 A 1/1999 Oguma et al.
5,933,888 A 8/1999 Foster et al.
6,516,479 B1 2/2003 Barbour
6,536,056 B1 3/2003 Vrzalik et al.
6,892,405 B1 5/2005 Dimitriu et al.

FOREIGN PATENT DOCUMENTS

WO WO 97/05844 A 2/1997

OTHER PUBLICATIONS

Burke, Inc., Advertising Material; The Burke Big Boy Bed, date unknown.
Burke, Inc., Owner's Manual and Guarantee; Burke Bariatric Treatment System, 1980.
Medicus, Inc., Advertising Material; Announcing the New Magnum Management System, date unknown.
Summary Statement, Health Implications of Obesity, National Institutes of Health Concensus Development Conference Statement, 1985, vol. 5 No. 9.
SMI, Advertising Material; Introducing Megabed 1000, date unknown.
PCT International Search Report; PCT International application PCT/US97/212815; Apr. 7, 1998.
PCT Written Opinion; PCT International application PCT/US97/21285; Oct. 13, 1998.
PCT International Preliminary Examination Report; PCT International application PCT/US97/21285; Feb. 11, 1999.
KCI Therapeutic Services; Pressure Reduction with Air Therapy, Jan. 1991.
SIZEWise Rentals and LTC Providers, Inc., An Informational Meeting for the BJC Health System, date unknown.
Burke, Inc., Advertising Material; Tri-Flex II, date unknown.

* cited by examiner

BARIATRIC BED APPARATUS AND METHODS

CROSS-REFERENCE TO RELATED APPLICATION

This is application is a continuing application, under 35 U.S.C. §120, of copending U.S. patent application Ser. No. 08/904,121, filed Jul. 31, 1997, which is a continuation of U.S. patent application Ser. No. 08/767,291, filed Dec. 16, 1996, which is a continuation-in-part of U.S. patent application Ser. No. 08/382,150, filed Jan. 31, 1995; the prior applications are herewith incorporated by reference in their entirety.

BACKGROUND OF THE INVENTION

1. Field of the Invention

The present invention relates to bariatric beds and, more particularly, to bariatric beds of the type convertible to a reclining bariatric chair and having features for facilitating the comfort, care and support of the bariatric patient.

2. Background of the Invention

The care of morbidly obese patients, also known as bariatric patients, presents many extraordinary challenges which have not been adequately addressed in the past. Not the least of the challenges is basic physical handling of such patients. Even partially lifting a bariatric patient often requires three or four very strong nurses. Supporting their huge size and weight on a bed likewise requires the bed to have tremendous structural strength and stability. An eight hundred pound patient will not only render many of the controls of a typical hospital bed inoperative, but will literally crush components just by sitting on the bed. Structural instability, moreover, tends to increase with complexity. Consequently, although standard hospital bed frames like the Hill-Rom 835 frame can be full-featured, caregivers of bariatric patients have long had to rely on bariatric beds with very basic support structures and limited features.

Examples of known bariatric beds include the "Magnum" bed previously manufactured by Mediscus Products Ltd. of Wareham, England and the "Burke" bed manufactured by Burke, Inc. of Mission, Kans.

SUMMARY OF THE INVENTION

It is a fundamental object of the present inventions to improve over the prior art, including to provide a bariatric bed and related methods which facilitate the care, comfort and support of bariatric patients. A related object is to provide a bariatric bed with features comparable to those of a conventional hospital bed while also providing features uniquely adapted for the care, comfort and support of bariatric patients.

These and other objects are addressed, in part, by providing a full-featured bariatric bed. One basic aspect of the invention is to provide such a full-featured bariatric bed wherein the frame includes a raise-and-lower mechanism together with controls for tilting the patient surface lengthwise, hence providing Trendelenburg and/or reverse Trendelenburg capabilities. Structure is also provided for articulating the patient surface from a relatively horizontal, lying position to a seated position. The raise-and-lower mechanism may include two separately actuated jacks of sturdy placement and construction, one for lifting the foot end of the bed's seat section and the other for lifting the head end of the bed's seat section. Such construction permits general raising or lowering of the entire patient surface by operating the jack motors synchronously in the same direction, and permits longitudinal tilting by operating the jack motors at different speeds or in opposite directions.

Another aspect of the present invention is the provision of opposite siderails that are both adjustable and retractable. The siderails are adjustable in the sense that they can be raised and locked in their operative position at a lateral distance (i.e., distance from the primary seat cushion) that is adjustable. They can be raised in a normal, inner position, or they can be adjusted to an extended position for particularly wide patients. They can even be adjusted further inward than their normal position without being removed from the bed, to a transport position for facilitating transport of the bed through standard hospital doorways. The siderails are retractable not only in the sense that they can be retracted to the transport position, but also in the sense that the can be easily lowered without removing them from the bed. To further enhance the user-friendliness of the bed, the invention also provides for the provision of identical bed controls built in to each of the opposite siderails. Thus all functions can be controlled from a convenient control panel. Such controls are integrated into the siderails without risking injury to the siderail data lines by directing those lines through a tunnel in the siderail mounting arms. Pendant controls may also be included for even greater ease of use.

Yet another aspect of the present invention is the provision of a bariatric bed including a balanced X-ray cassette holder for enabling use of a radioluscent head section thereof. The entire central span of the head (and chest) section may be radioluscent, and the balanced X-ray cassette holder allows adjustment of X-ray film position thereunder.

The present invention also provides a bariatric bed having a footboard which is adapted for use as a step to enable ingress and egress relative the bed. Such a footboard may be pivotally connected to the leg section of the bariatric bed so that it can pivot into close engagement with the floor when stepped on. Damping cylinders and springs may be used to optimally restrict such pivoting in use, and upper and lower cushions, ideally of different properties, may be employed for further benefits.

Although some details are summarized above, this summary generally only begins to touch on the broader technological categories to which the present inventions are directed. Many other objects, features and advantages of the present inventions will be evident to those of skill in the art in view of the foregoing and following more detailed descriptions, particularly when considered in light of the prior art and/or the claims appended hereto.

BRIEF DESCRIPTION OF THE DRAWINGS

FIG. 4A is an enlarged scale sectional view showing the flexure elements of the scale mechanism which dependently attach the load frame 62 to the base frame 61.

DESCRIPTION OF THE PREFERRED EMBODIMENTS

Figure 1:
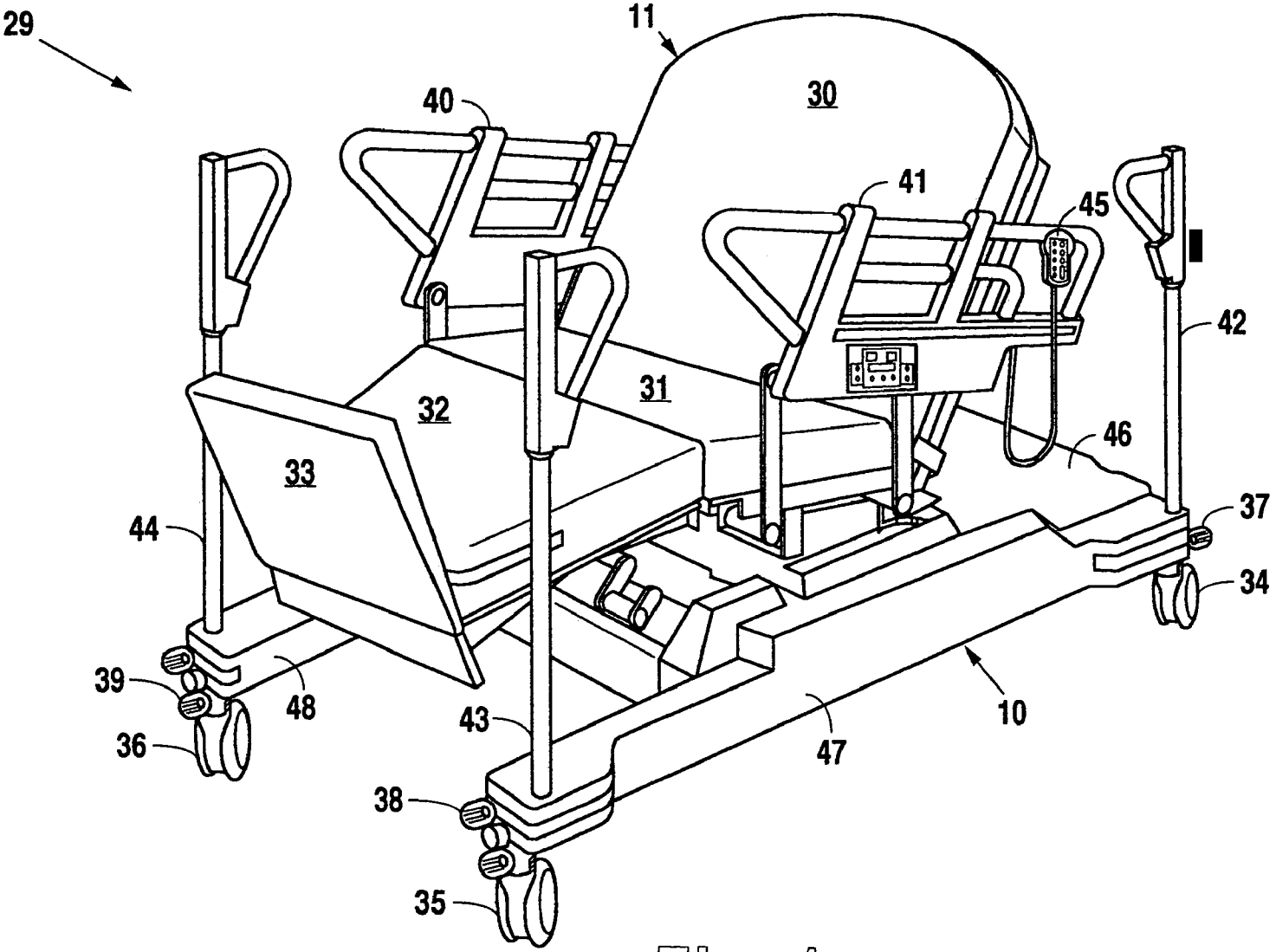
FIG. 1 is a perspective view of a bariatric patient treatment bed 29 comprising the presently preferred embodiment of the invention described herein.
Figure 2:
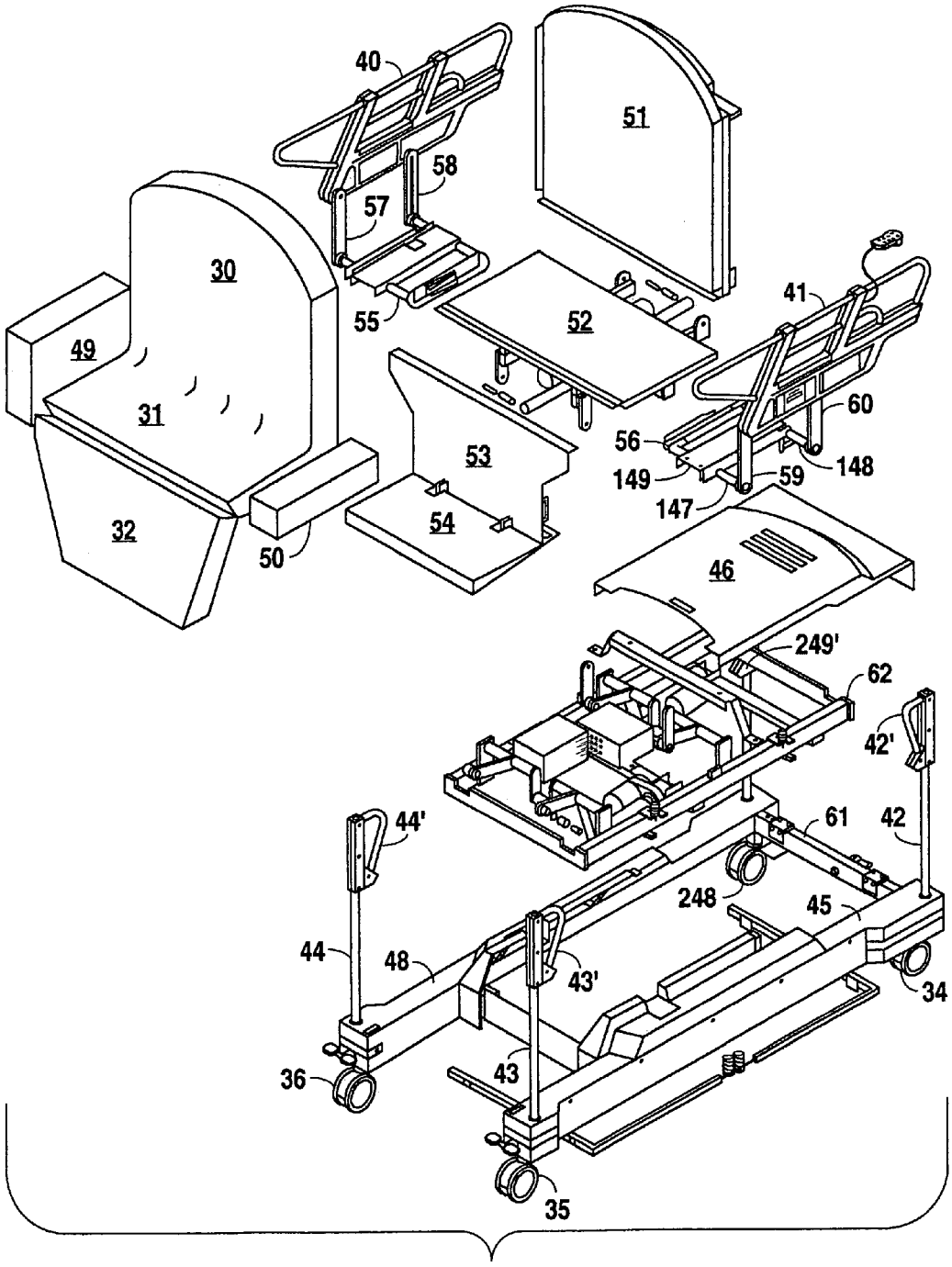
FIG. 2 is an exploded perspective view of the bariatric patient treatment bed 29 of FIG. 1.
Figure 6:
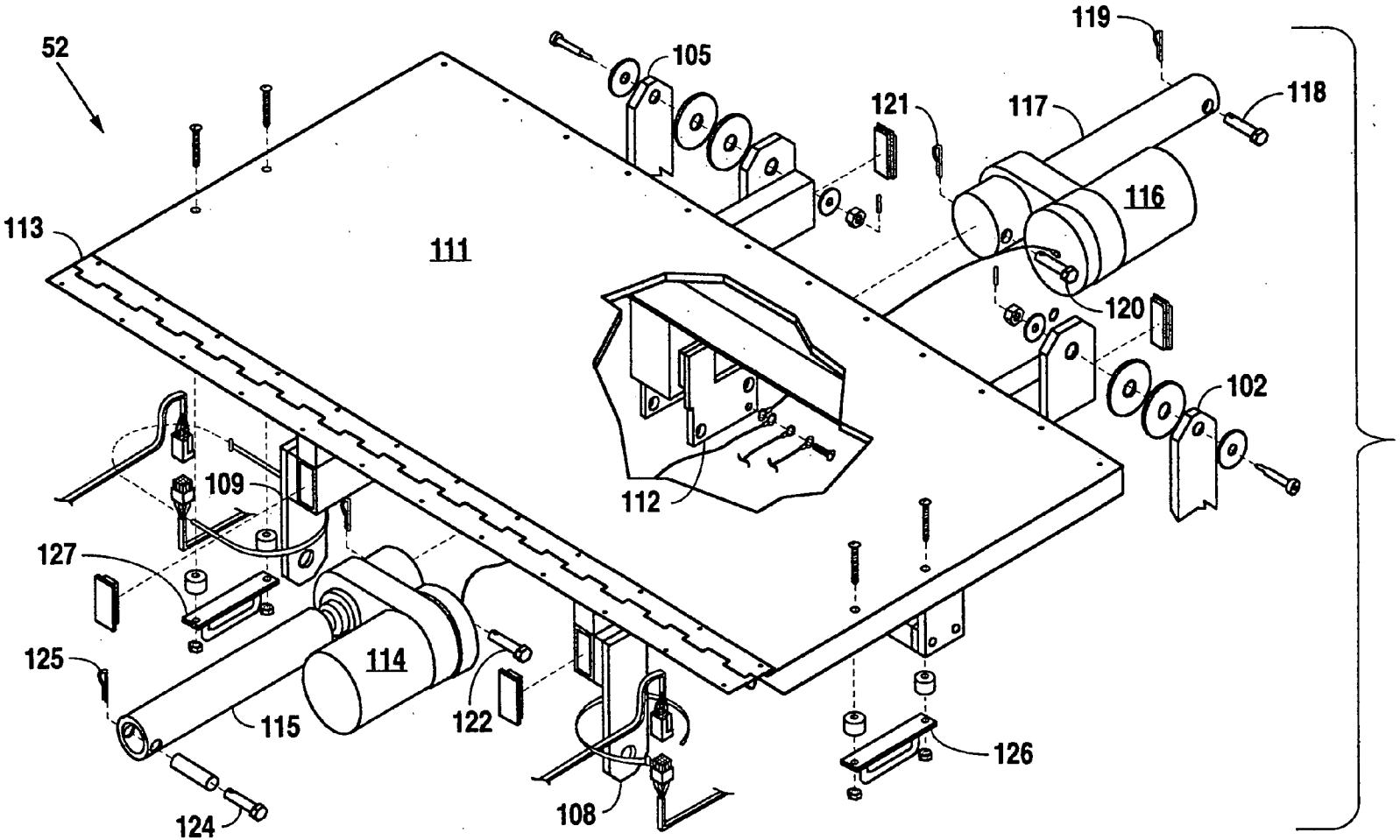
FIG. 6 is an exploded perspective view of the seat assembly of the bed of FIG. 1.
Figure 7:
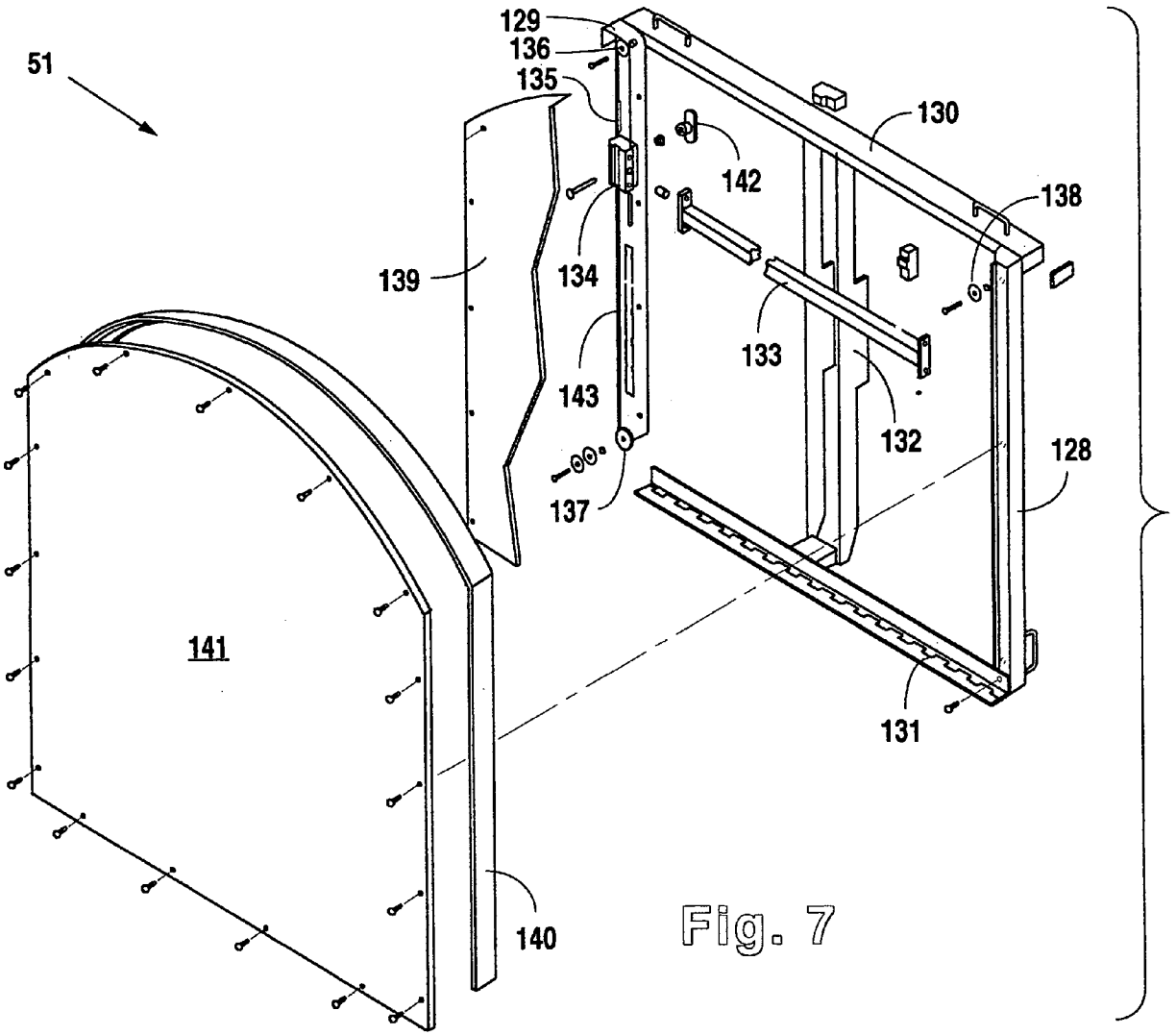
FIG. 7 is an exploded perspective view of the head and X-ray assembly of the bed of FIG. 1.
Figure 9:
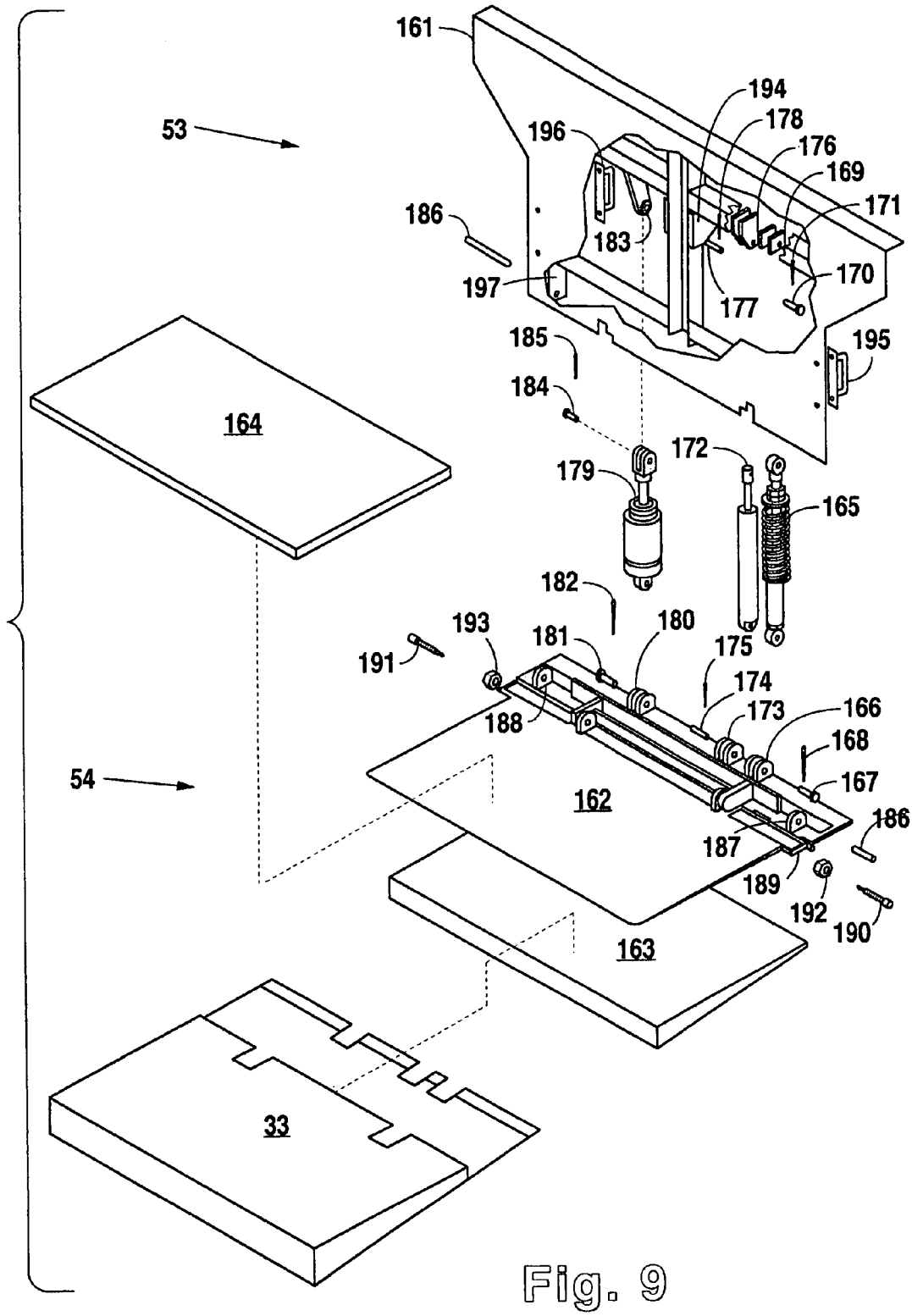
FIG. 9 is an exploded perspective view of the leg and foot assemblies of the bed of FIG. 1.

Referring to FIGS. 1 and 2, there is shown a treatment bed 29 uniquely indicated for bariatric patients, i.e. patients weighing in excess of 500 pounds, commonly in the range of 500-800 pounds. The bed 29 shown is considered to be the presently preferred embodiment of the inventions described and claimed herein. The frame 10 of bed 29 (with particular reference to FIG. 2) generally comprises base frame 61, load frame 62 and assemblies 51, 52, 53 and 54. The basic mattress 11 for patient surfaces, of bed 29 consists of Cushion assemblies 31-33, although overlay surfaces may also be implemented on top of the basic mattress 11 controls for the bed 29 are contained in the frame 10, including in its side rails 40-41 and it's pendant. Frame assemblies 51-54 and corresponding cushion assemblies provide support for the patient's head, buttocks, legs and feet, respectively. Head and X-ray assembly 51 (also referred to as "X-ray assembly 51") further comprises a mechanism for holding an X-ray cassette as shown by FIG. 7 and detailed further herein. Seat assembly 52 further comprises jack motors 114 and 116 as shown in FIG. 6. Jack motor 114 and 116 are used to adjust the angular orientation relative to seat assembly 52 of head and X-ray assembly 51 and leg assembly 53, respectively, as will be evident further herein. Foot board assembly 54 is dependently attached to leg assembly 53 by connections providing useful benefit to both the patient and care giver as shown in FIG. 9 and detailed further herein. Cushion assemblies 30, 31, 32 and 33 rest upon head assembly 51, seat assembly 52, leg assembly 53, and foot board assembly 54, respectively. Cushion assemblies 30-33 engage the patient to provide comfortable support thereof.

Figure 3:
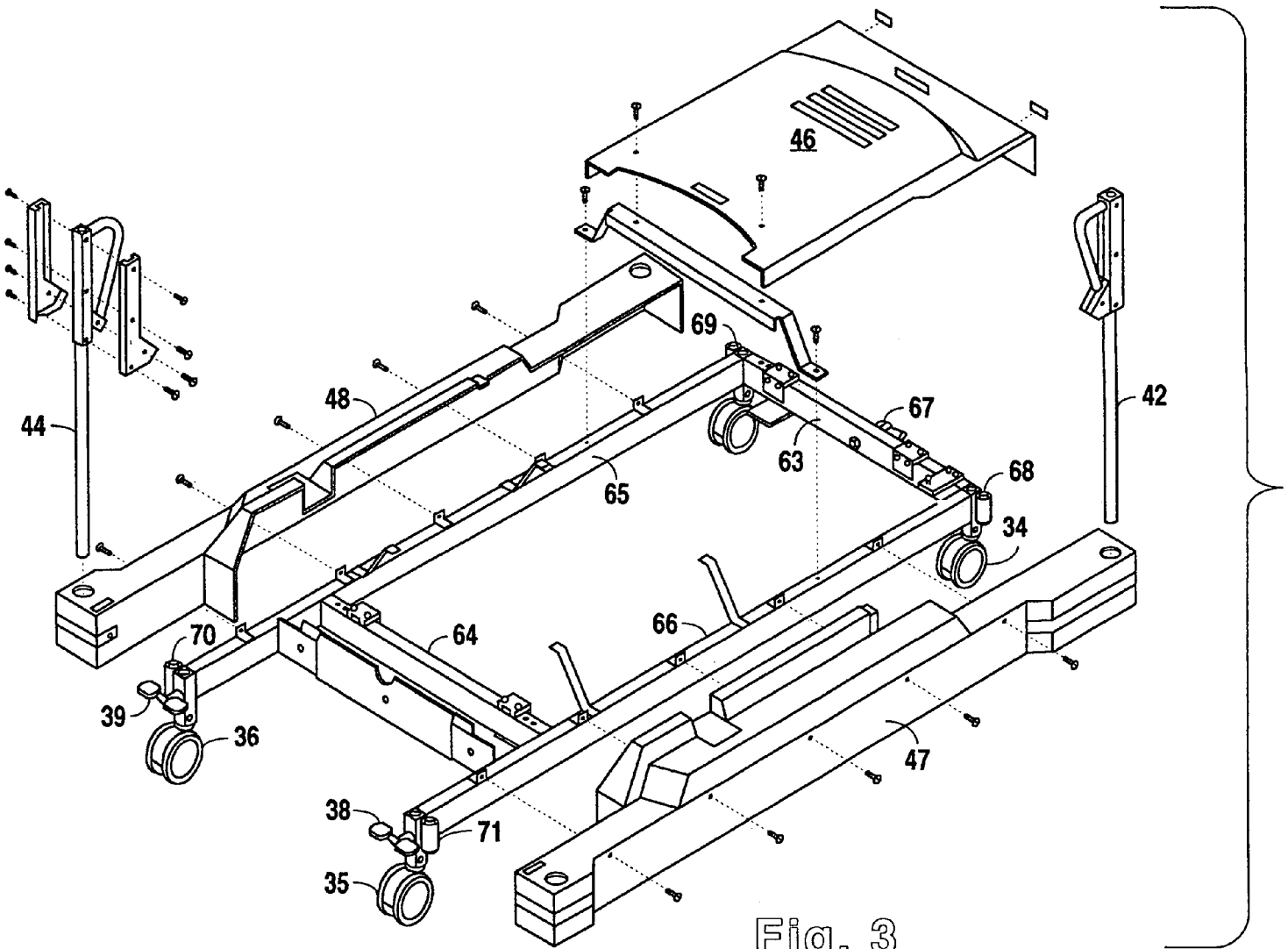
FIG. 3 is an exploded perspective view of the base frame 61 and plastic base frame covers 46-48 and 250 for the bed 29 of FIG. 1 shown with some parts removed for clarity.

As best shown in FIG. 3, base frame 61 generally comprises longitudinal beams 65 and 66 and transverse elements 63 and 64. Base frame 61 further comprises a plurality of floor engaging casters 34, 35, 36, and 248 conventionally journaled near the four corners of said frame. Locking mechanisms 37, 38 and 39 and a fourth of the same kind (not shown) are provided for casters 34, 35, 36, and 248, respectively. Such locking mechanisms may be set to prevent either rotation or steering of the casters 34-36 and 248, hence holding bed 29 stationary, as is conventional with many hospital bed frames. Weldments 68-71 are provided which allow location of corner posts 42-44 and 249 on which may be installed intravenous injection (IV) holders or standard traction frames. Corner posts 42-44 and 249 are adapted with convenient integral hand holds 42'-44' and 249' to facilitate patient entrance or exit of bed 29. The hand holds 42'-44' and 249' provided by corner posts 42-44- and 249 may also assist caregivers in transport of bed 29. Molded plastic covers 46-48 and 250 enhance aesthetic appeal and provide convenient locations for affixing instruction or warning labels. Bumpers made of rubber or other similar materials may also be installed on covers 47 and 48 for protection of both bed 29 and the walls and doorways of the facility where the bed is used.

Figure 4:
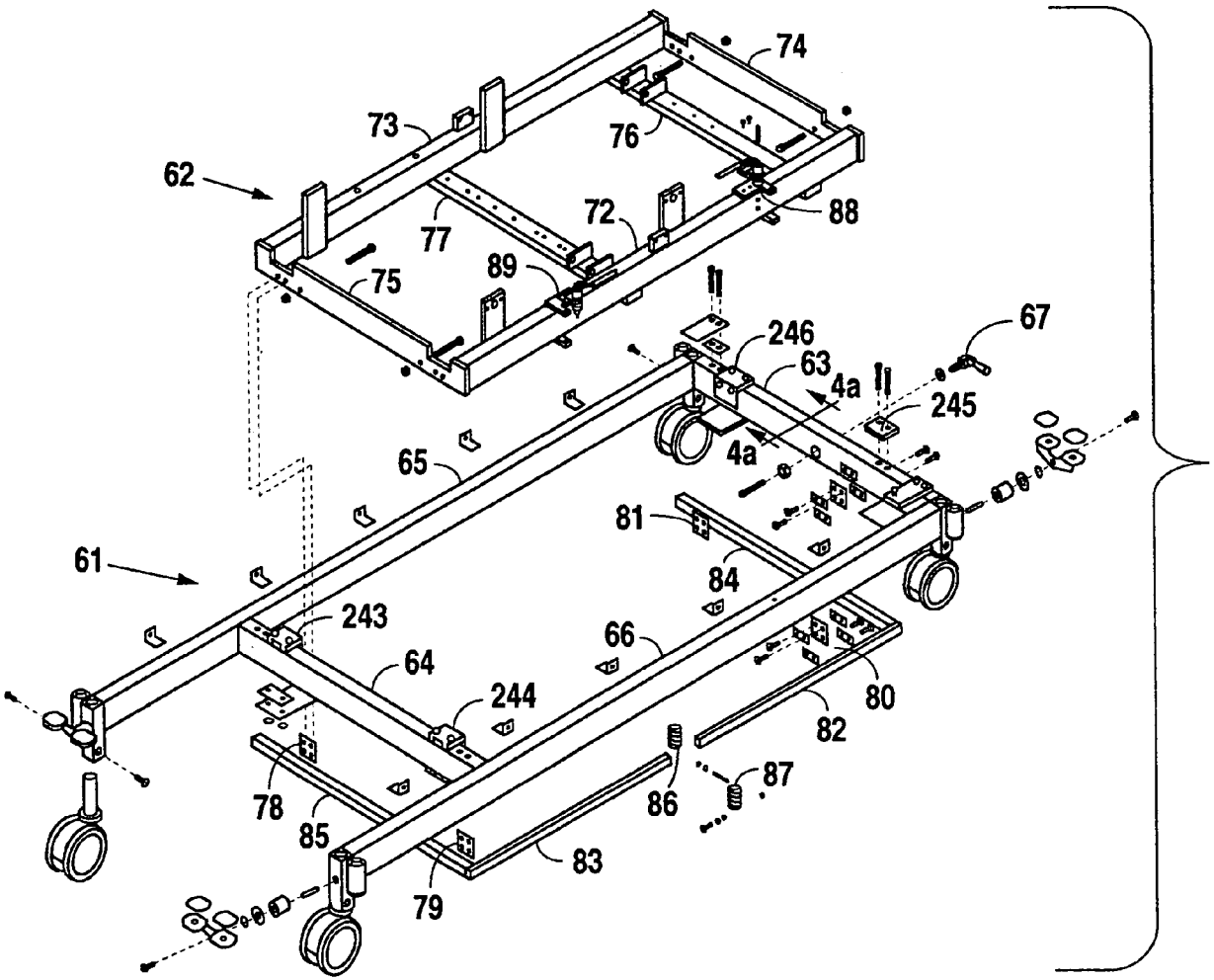
FIG. 4 is an exploded perspective view of the base frame 61, load frame 62 and scale mechanism of the bed of FIG. 1 shown with some parts removed for clarity.

As best shown in FIG. 4 load frame 62 generally comprises longitudinally disposed beams 72 and 73 and transverse elements 74 and 75. Additional transverse elements 76 and 77 are used for attachment of jack motors 90 and 92, respectively. The description and function of motors 90 and 92 will be apparent further herein. Load frame 62 is referred to as such because it carries the entire load of the patient surface 11. Load frame 62 dependently attaches to base frame 61 in a way that weighs that load as it is transmitted to base frame 61. That connection between bed frame 62 and base frame 61 is provided by a scale mechanism is well known in the art and similar to that described in U.S. Pat. No. 4,793,428, incorporated herein by this reference. The scale mechanism comprises a pair of displacement transmitting members 84 and 85 which are respectively connected between transverse elements 63 and 74 and 64 and 75 via flexures 78-81 and 243-246.

Referring to detail FIG. 4A, transmitting member 84 is shown as attached to base frame element 63 via flexure 246 and load frame element 74 via flexure 81. Attachment in this manner causes displacement of bars 82 and 83 which are connected to members 84 and 85 in cantilevered manner. Displacement, which is limited by springs 86 and 87, is measured in the area of springs 86 and 87 by linear variable differential transformers (LVDTs) 88 and 89. Displacement measured by LVDTs 88 and 89 corresponds in direct proportion to the weight of the load frame and all which is supported thereby. Locking mechanism 67 comprising common hardware is desired to prevent motion of load frame 62 relative to base frame 61 during transport of bed 29. This serves to prevent damage of the scale mechanism due to excessive forces as may be encountered when attempting to negotiate a short step or the like. Other conventional mechanical stops are also used to limit movement and prevent damage in normal use, when locking mechanism 67 is not in use.

Figure 5:
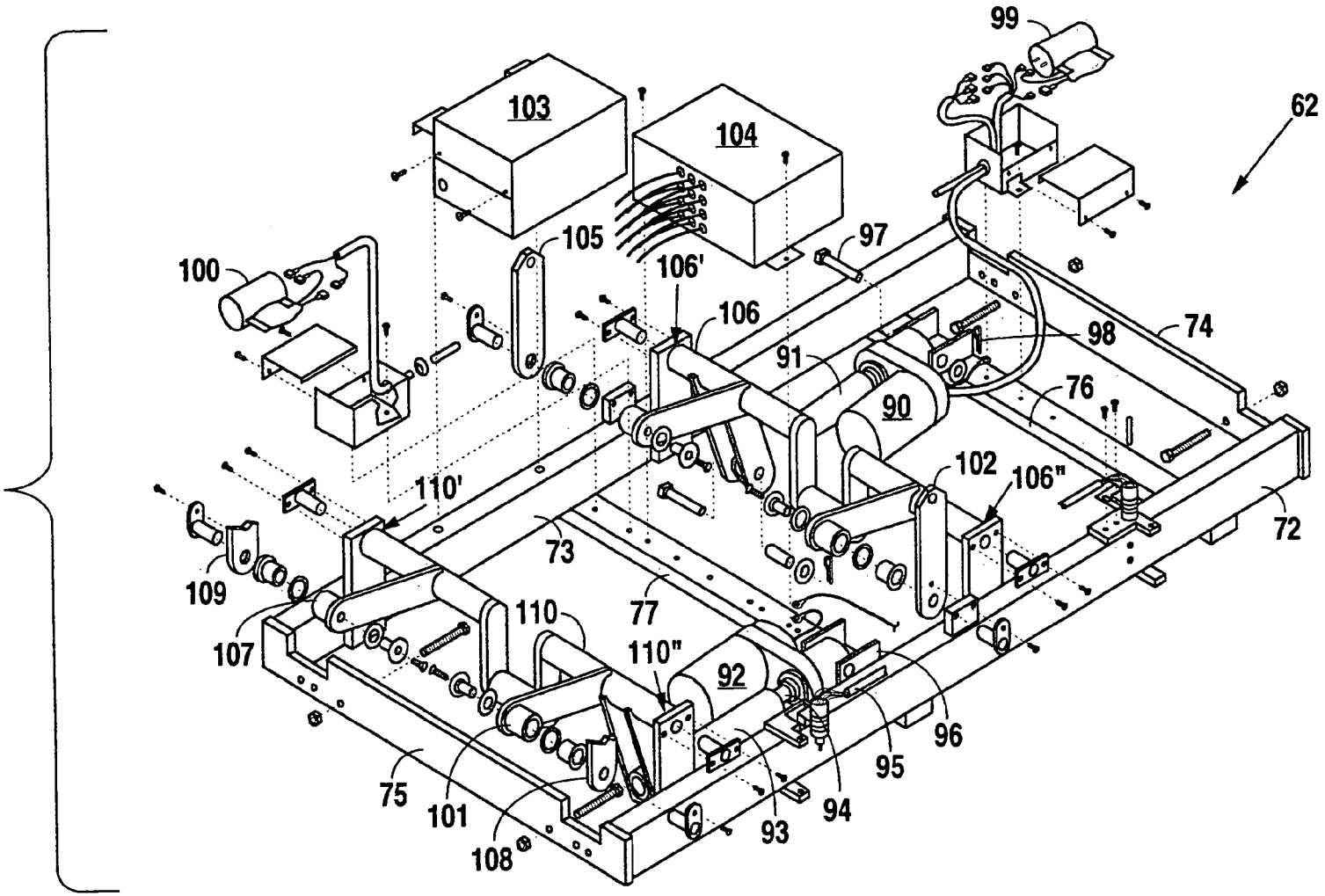
FIG. 5 is an exploded perspective view the load frame of the bed of FIG. 1.

Referring to FIGS. 5 and 6, raise-and-lower mechanism for producing vertical movement Trendelenburg tilting of the seat assembly 52 is shown in detail. In particular, head torque arm weldment 106 and foot torque arm weldment 110 are pivotally attached to load frame 62. Seat assembly 52 is dependently attached to weldments 106 and 110 by members 102, 105,108 and 109. Specifically, foot torque arm weldment 110 connects at points 101 and 107 to members 108 and 109 by bushings and other necessary hardware as is well known in the art of manufacturing hospital beds. Head torque arm 106 and foot torque arm 110 weldments are articulated about their pivotal attachments to load frame 62 (numbered 106', 106" and 110', 110', respectively) by extension or retraction of jack tubes (or "sleeves") 91 and 93 by jack motors 90 and 92, respectively. Jack motors 90 and 92, of the type referred to in the industry as linear actuators, attach transverse members 76 and 77 of load frame 62 by torque arm pins 95 and 97 themselves affixed by cotter pins 96 and 98.

Extension of tube 93 by motor 92 causes weldment 110 to pivot relative to load frame 62 such that points 101, 107 and corresponding members 108, 109 articulate upwardly. Likewise, extension of tube 91 by motor 90 causes weldment 106 to pivot such that members 102 and 105 articulate upwardly. Retraction of tubes 93 or 91 would have the opposite effect, that of lowering members 108, 109, or 102, 105. Said articulation has the effect of causing members 102, 105, 108 and 109 to raise or lower in vertical motion, thereby raising or lowering seat assembly 52 in vertical motion. In the preferred embodiment, such articulation as raises seat assembly 52 is said to provide a BED UP function. Such articulation as lowers seat assembly 52 is said to provide a BED DOWN function. It is believed that the system described herein having mechanically articulated attachment points at the four corners of seat assembly 52 promotes greater stability than would a system utilizing hydraulic type cylinders wherein the support is typically concentrated along a single longitudinal axis.

Articulation by one jack motor 90 or 92 greater or less than that of the other jack motor 92 or 90 has the effect of establishing the patient support surface in a Trendelenburg or reverse Trendelenburg treatment position. Trendelenburg and reverse Trendelenburg therapy is well know in the art for treatment of certain cardiac conditions and is considered an important feature for many conventional hospital beds, although the excessive weight of bariatric patients has led the art away from incorporating such features in a bariatric bed. The preferred embodiment is capable of achieving ten degrees Trendelenburg or twelve and one half degrees reverse Trendelenburg therapy. Articulation to effect such treatment is referred to as providing the TRENDELENBURG or REVERSE TRENDELENBURG function.

Referring now to FIG. 5 only, load frame 62 is shown to be a convenient location for mounting of transformer assembly 103 and junction box assembly 104. The functions of each of the assemblies will be detailed further herein. Additionally, inductor-capacitor-resistor (LRC) networks 99 and 100 are conveniently mounted on load frame 62 so as to conserve space within junction box assembly 104. LRC networks assemblies 99 and 100 are primarily indicated for the capacitive startup of jack motors 90 and 92 and protection of the power distribution and control system from back electromotive forces (EMF) generated by said initial startup of either jack motor 90 or 92.

Referring to FIGS. 6 and 7, it is shown that head assembly 51 is dependently attached to seat assembly 52 by laterally oriented hinge 131. Articulation of head and X-ray assembly 51 about hinge 131 is effected by extension or retraction of jack sleeve 117 under the force of jack motor 116. Jack motor 116, of the type referred to in the industry as a linear actuator, dependently attaches to seat assembly weldment 112 by pin 120, itself affixed by cotter pin 121. Jack sleeve 117 attaches to head and X-ray assembly weldment 132 by pin 118, itself affixed by cotter pin 119. In the preferred embodiment extension of jack sleeve 117 is said to provide a HEAD UP function. Retraction of jack sleeve 117 is said to provide a HEAD DOWN function. Head and X-ray assembly 51 is detailed further herein.

Referring now to FIG. 7, the head assembly 51 for treatment bed 29 is shown. Head assembly 51 generally comprises rail 140 encompassing head board 141 which together are mated with weldments 128,129 and 130. Weldments 128 and 129 produce a channel for horizontal containment of an X-ray cassette. Transverse weldment 130 combines with hinge 131 and weldment 132 to provide structural support of head and X-ray assembly 51. X-ray board 139 serves to maintain the right angled shape of the perimetrical structure thereby aiding in ensuring ease of insertion and removal of an X-ray cassette. X-ray board 139 and head board 141 comprise a radioluscent material in the preferred embodiment. While it is well known in the art of design and manufacture of patient treatment beds to provide a mechanism for holding an X-ray cassette behind the patients head and chest areas, prior art designs have not improved the means for insertion and removal of the X-ray cassette. Specifically it is desirable to be able to raise or lower the cassette from one side only so that in cases where access to the treatment bed may be limited to one side, by a wall or medical apparatus, for instance, an X-ray cassette still may be easily inserted and subsequently removed. Because prior art embodiments of bariatric beds do not provide mechanisms for keeping the sides of an X-ray cassette parallel with the sides of holding assembly, the caregiver has been forced to have access to both sides of the treatment bed in order to manually guide the cassette into place. The embodiment detailed herein utilizes a mechanism from other arts to provide a solution to the problem described. A block and pulley system comprising a left block and right block 134, plurality of single pulleys 136 and 138, plurality of double pulleys 137 and plurality of cables 135 allows X-ray bar 133 to be raised and lowered from one only of a plurality of handles 142 all the while maintaining position parallel to transverse element 130. The handles 142 may lock at a plurality of vertical positions within slots 143 in channel members 128 and 129. Although referring to an un-related field of art, the block and pulley system shown is similar to that described in U.S. Pat. No. 5,295,430, incorporated herein by this reference.

Referring now to FIGS. 6 and 9, it is shown that leg assembly 53 is dependently attached to seat assembly 52 by laterally oriented hinge 113. Articulation of leg assembly 53 about hinge 113 is effeted by extension or retraction of jack sleeve 115 under the force of jack motor 114. Jack motor 114, of the type preferred to in the industry as a linear actuator, dependently attaches to seat assembly weldment 112 by pin 122, itself affixed by cotter pin 123. Jack sleeve 115 attaches to leg assembly weldment 194 by pin 124, itself affixed by cotter pin 125. In the preferred embodiment, extension of jack sleeve 115 is said to provide a LEGS UP function. Retraction of jack sleeve 115 is said to provide a LEGS DOWN function. Leg assembly 53 is detailed with foot board assembly 54 further herein.

In the preferred embodiment, full extension of jack sleeve 117 in order to provide full HEAD UP and simultaneous full retraction of jack sleeve 115 in order to provide full LEGS DOWN causes conversion of patient treatment bed 29 into a reclining chair. In combination with unique benefits provided by the leg and foot board assemblies 53 and 54, detailed further herein, the chair position of treatment bed 29 particularly facilitates entrance or exit of the bed by a bariatric patient. It should also be noted that seat assembly 52 provides convenient mounting for patient restraint system weldments 126 and 127.

Referring to FIG. 9, there is best shown foot board assembly 54 as dependently attached to leg assembly 53, also shown. Leg assembly 53 generally comprises leg plate 161 as reinforced by "I" shaped weldment 194. Weldment 194 itself comprises a plurality of attachment points 169, 176 and 183, the purpose of which will be evident herein. Foot board assembly 54 generally comprises foot plate 162, a plurality of hinges 186 and 189, cushions 163 and 164 and heavy duty fabric cover 33 The cover 33 in the preferred embodiment, is "Dartex"P109" available from Penn-Nyla of Nottingham England, as is the fabric covering for the whole of mattress 11.

As for the foam used in mattress 11, a wide variety may be suitable; however, with the exception of cushions 163 and 164, the foam used in the preferred embodiment is an antimicrobial open-cell polyurethane foam having a density of 1.8 pounds per cubic foot and 36 pounds compression. The foam used for cushion 163 in the preferred embodiment is similar but has a relatively large density of 2.7 pounds per cubic foot and 70 pounds compression. The foam used for cushion 164 in the preferred embodiment is also similar but is less dense than cushion 163, having a density of 2.0 pounds per cubic foot and 41 pounds compression. Both cushions 163 and 164 are wedge-shaped, with their greater thicknesses (roughly 1.75" and 0.5", respectively) being distal to hinge 189. The relative characteristics of these foam cushions serve their varied purposes.

It is well know in the art of design and manufacture of bariatric patient treatment beds to provide a means by which the patient can easily enter or exit the bed. Bariatric patients are often not able to hop or step down even short distances without injury or loss of balance. It is therefore to provide a means for entrance or exit which lifts the patient into the bed and similarly sets the patient's feet very near the floor when exiting the bed. In the prior art, it has been shown that a rigid foot board in combination with a chair position feature, as previously detailed herein, facilitates bariatric patient care. However, measures are taken to ensure such foot boards are not used as a step when exiting the bed, presumably for safety reasons in view of the excessive weight of bariatric patients. The present invention goes against such teachings by providing a footboard 54 which is adopted to be used safely as a step for bariatric patients.

Referring still to FIG. 9, the attachment of foot board assembly 54 to leg assembly 53 is shown. Such attachment provides gradual increase in rigidity as weight is applied to foot cushion 35, so as to provide adequate support of the bariatric patient entering or exiting bed 29 yet avoiding fixed resistance to a sudden increase in force. It is shown that the primary attachment of foot board assembly 54 to leg assembly 53 is by hinge 186 through weldments 187 and 188 on the foot board assembly 53 and a plurality of holes 197 in weldment 194 of the leg assembly 53. Articulation about said hinge 186 is constrained by damping cylinders 172 and 179 and spring 165 as detailed further herein. Spring 165, in compression, attaches to leg assembly weldment 169 by pin 170 itself affixed by cotter pin 171. Spring 165 attaches to foot board assembly weldment 166 by pin 167, itself affixed by cotter pin 168. Hydraulic cylinder 179, of the type which dampens primarily in compression, attaches to leg assembly weldment 183 by pin 184 itself affixed by cotter pin 185. Hydraulic cylinder 179 attaches to foot board assembly weldment 180 by pin 181, itself affixed by cotter pin 182. Hydraulic cylinder 172, of the type which dampens primarily in tension, attaches to leg assembly weldment 176 by pin 177 itself affixed by cotter pin 178. Hydraulic cylinder 172 attaches to foot board assembly weldment 173 by pin 174, itself affixed by cotter pin 175. The particular cylinder 179 selected in the preferred embodiment is an adjustable cylinder having a two-inch stroke and available through Enidine of Orchard Park, N.Y., part number (LR)OEM1.5M X2 The particular cylinder 172 selected in the preferred embodiment is an adjustable cylinder having a four-inch stroke and available through Enidine of Orchard Park, N.Y., part number ADA510T. The particular spring 165 selected in the preferred embodiment is a medium load round wire spring available through Lee Spring Company of Brooklyn, N.Y., part number LHL-1 500A-9MW.

Under the weight of a bariatric patient, hydraulic cylinder 179 increasingly resists articulation of foot board assembly 54 about hinge 186. Gradually, resistance will increase as more weight is applied by the patient. In this manner, foot board assembly 54 is able to provide increasingly rigid support of the bariatric patient while minimizing any risk of 54 snapping under the weight of a typical bariatric patient. Further if a bariatric patient should apply weight onto foot board 54 at excessive speed, the dampening action of hydraulic cylinder 179 may serve to prevent injury to the patients knees and legs. One weight is removed from foot board 54 (such as once patient has completely exited bed 29), spring 165 returns foot board assembly 54 to its original position with respect to leg assembly 53. Hydraulic cylinder 172 in tension dampens the return motion of spring 165 This damping helps prevent snapback of the foot board assembly 54, which might otherwise present safety hazards.

The cushion 33 not only enhances patient comfort but can also cushion engagement of foot board 54 with the floor, as the patient exits or enters bed 29. Additionally, in case a care giver is unalert and places a foot beneath foot board assembly 54, and a patients weight does cause foot board assembly 54 to contact the caregiver's foot, heavy padding of cushion 163 distributes the weight and cushions the foot to help prevent excessive discomfort to the caregiver.

Pins 190 and 191 held in position beneath foot board assembly 54 by nuts 192 and 193 may be placed in a release position so as to allow foot plate 162 to articulate about secondary attachment hinge 189. Said release allows patient support foot cushion 33 to lie coplanar with leg cushion 32. This may be desirable when the bed surface is in a horizontal position if the caregiver wishes to minimize pressure against the patients feet.

Figure 8:
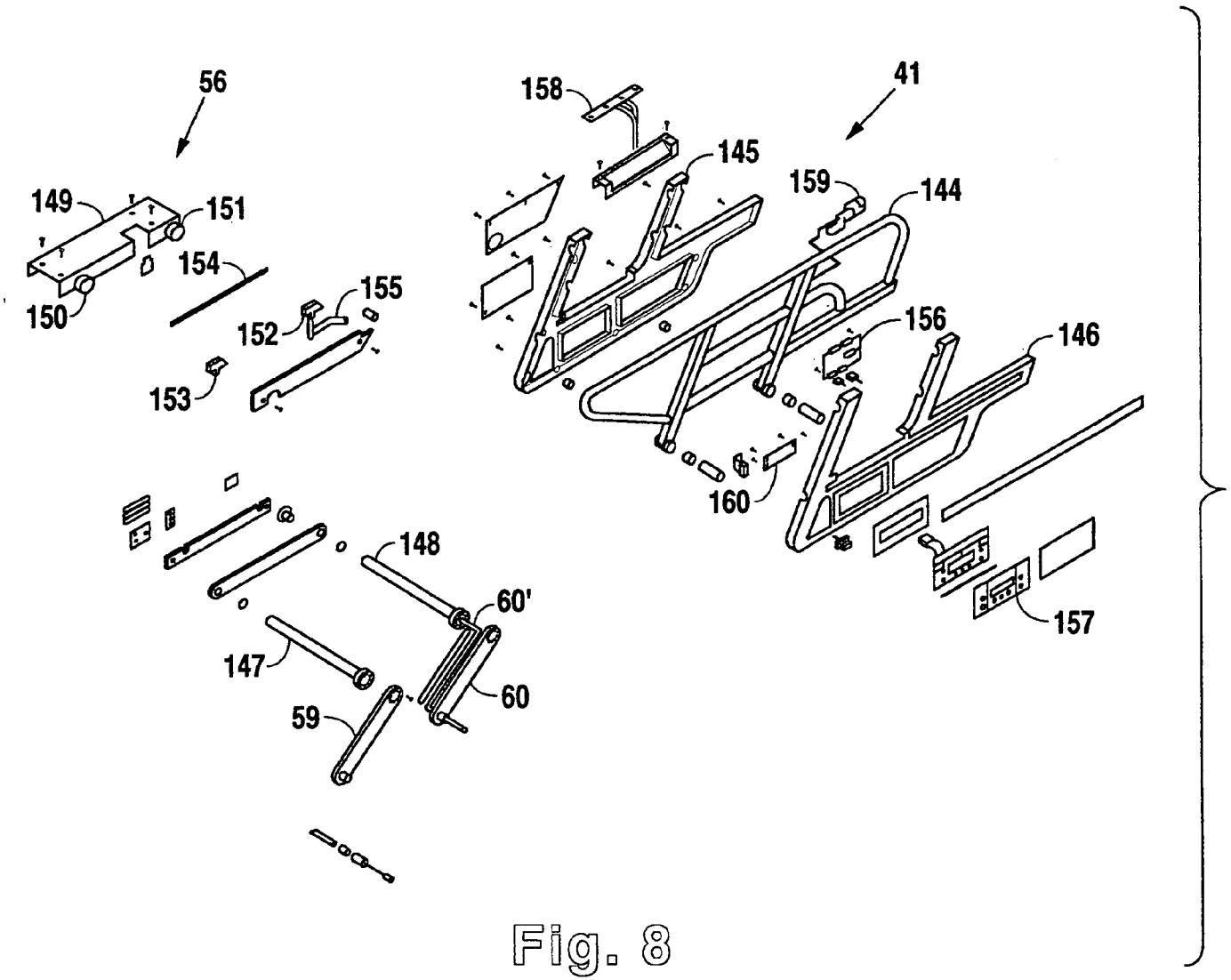
FIG. 8 is an exploded perspective view of the left hand side rail assembly of the bed of FIG. 1.

As is best shown by FIG. 8, the left side rail generally comprises metal frame 144 encased by molded plastic covers 145 and 146. Frame 144 is generally dependently attached to side rail mounting plate 149 through weldments 59 and 60 and shafts 147 and 148. Weldments 59 and 60 and shafts 147 and 148 are themselves major components of a mechanism 56 for raising and lowering of side rail assembly 41. Said mechanism 56 is also utilized for lateral translation of side rail assembly 41 thereby extending or compressing the lateral dimension of treatment bed 29. Details of the manufacture and use of mechanism 56 will be evident further herein.

Figure 10:
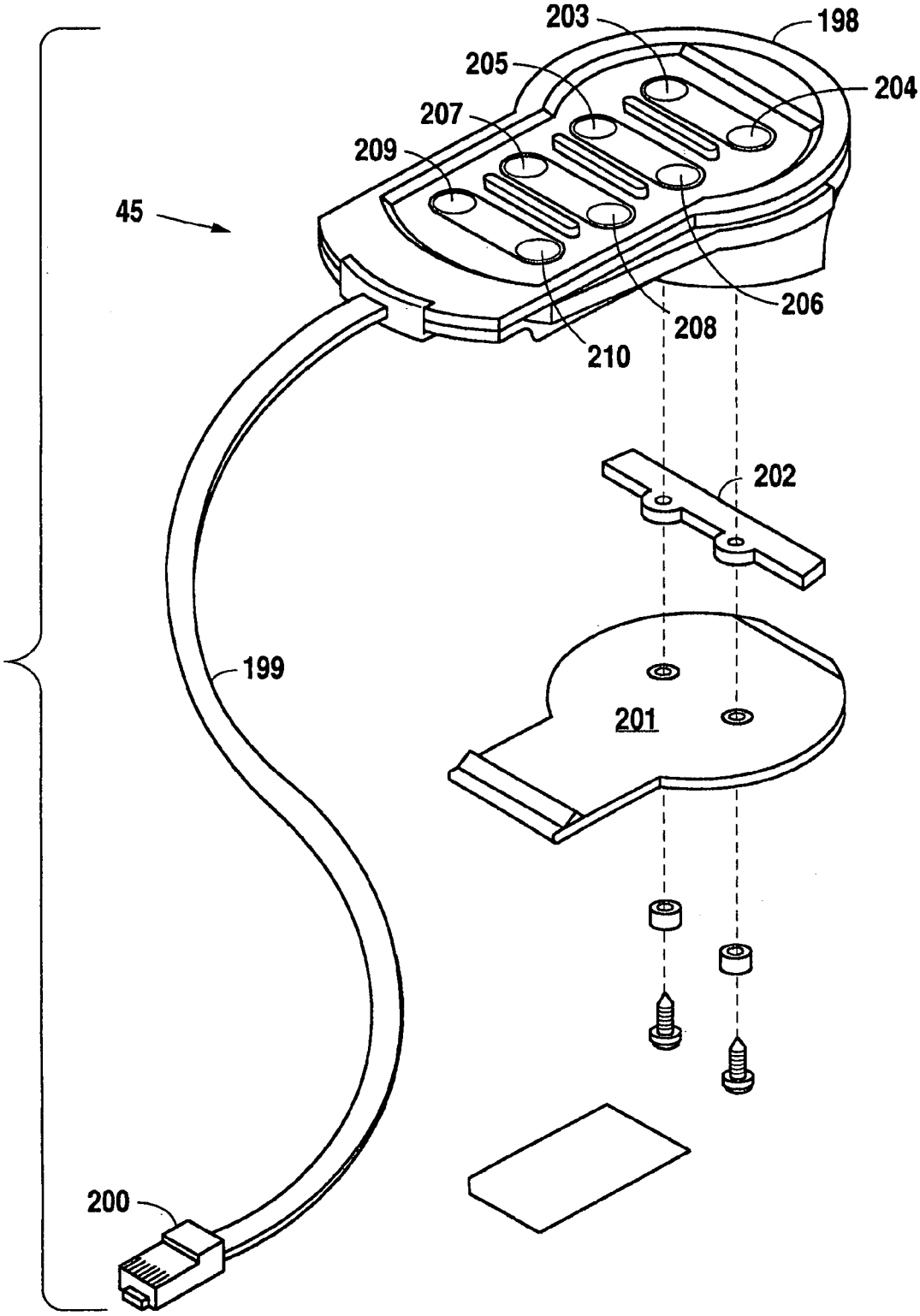
FIG. 10 is an exploded perspective view of the hand held control pendant for the bed shown in FIG. 1.
Figure 11:
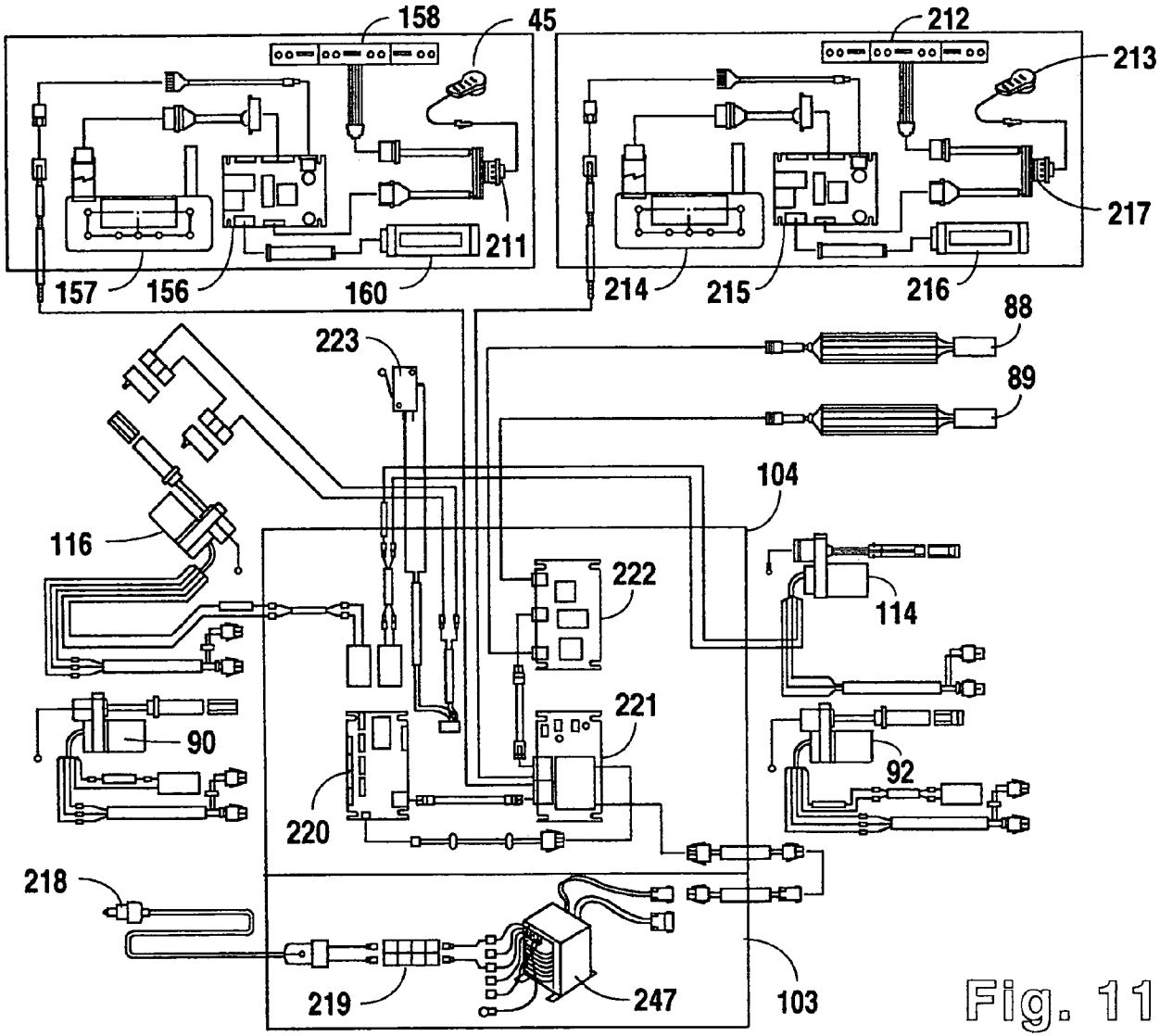
FIG. 11 is a schematic view of the power distribution and control system for the bed of FIG. 1.

Referring, still to FIG. 8, molded plastic covers 145 and 146 serve not only to provide aesthetically pleasing appearance, but provide mounting for a side rail micro-controller unit 156, scale function membrane switch 157, and bed function membrane switch 158. Additionally, covers 145 and 146 provide mounting for a liquid crystal display (LCD) 160 and receptacle 159 used to provide optionally connectivity for a hand held bed function control pendant 45. Pendant 45 is shown in FIG. 10 and detailed further herein.

Figure 12:
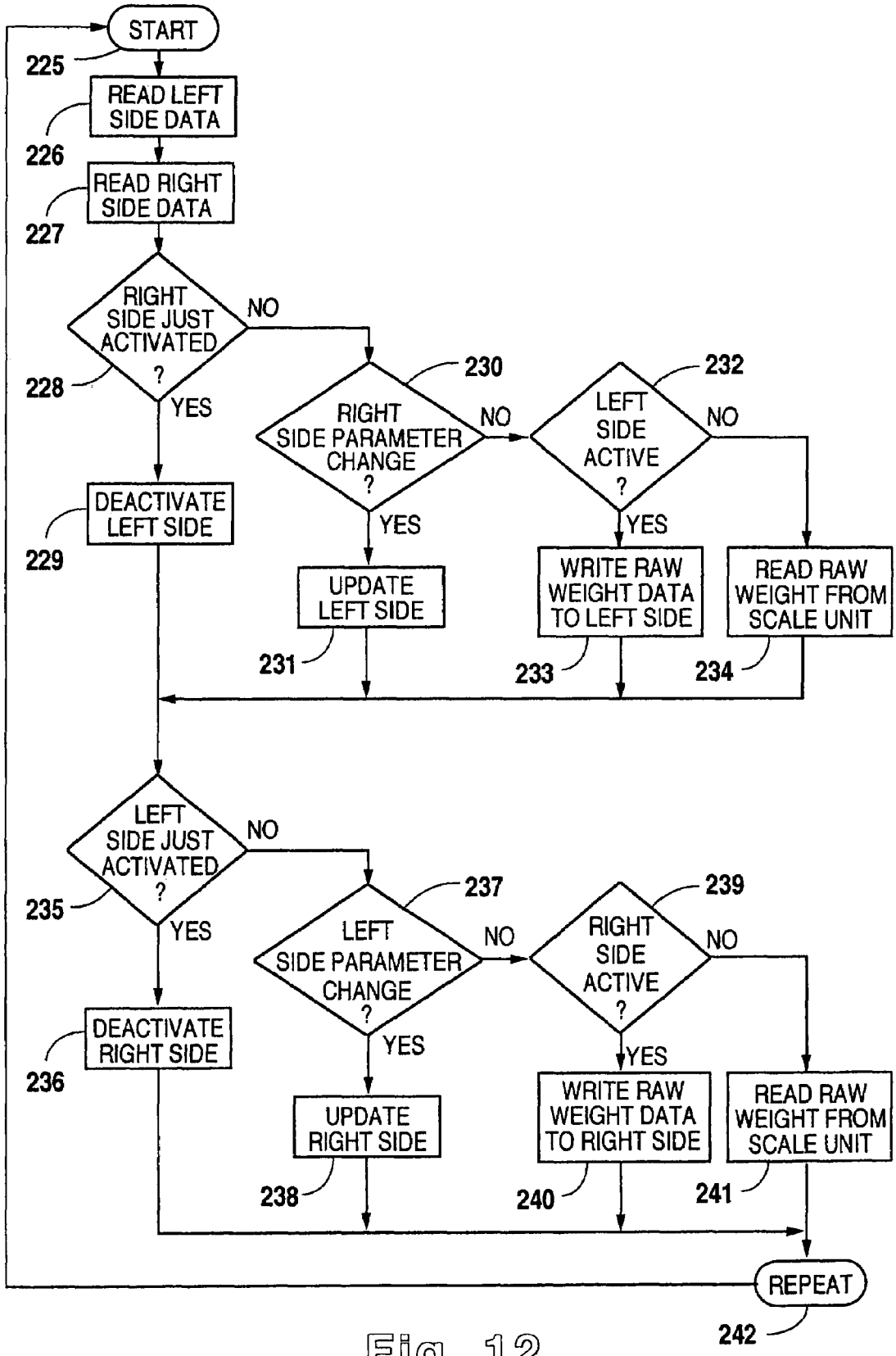
FIG. 12 is a flow chart showing serial communication for the control system of FIG. 11.

Scale function membrane switch 157 allows a caregiver to effect scale operations such as ZERO, HOLD, WEIGH DELAY, SET and EXIT ALARM. Liquid crystal display 160 is necessary for visual feedback to the care giver in effecting scale operations as such effect takes place through a system of menus. The details of all scale operations will be evident further herein. Bed function membrane switch 158 allows a caregiver to effect operations of BED UP, BED DOWN, HEAD UP, HEAD DOWN, LEGS UP, LEGS DOWN, TRENDELENBURG and REVERSE TRENDELENBURG as previously described. Side rail micro-controller unit 156 processes input from scale function membrane switch 157 and bed function membrane switch 158 and generates display information for LCD 160. Data communication from the switches 157 and 158 and the other control components in siderail 144 are conveyed to the master controller via line 60', which passes through a central tunnel in member 60 and shaft 148. As will be evident further herein, micro-controller unit 156 serves as a slave in the serial communications architecture of the preferred embodiment. This architecture is shown in FIG. 12.

The scale function ZERO allows the weight of the bed to be set to zero prior to patient placement thereby compensating for linens and accessories. Scale function HOLD retains the current weight in memory while additional items, such as traction equipment, are added thereby eliminating inaccuracies as would otherwise be introduced by such activity. The scale function WEIGH DELAY postpones weighing for a specified time while tubes, drainage bags and the like are lifted thereby giving accurate reflection of the patient's weight only. Scale function SET is used to enter a previously known weight of the patient. Scale function EXIT ALARM detects weight decreases of ten percent or more and in such case sounds an audible alarm.

Referring back to FIG. 2, wherein both left side rail 41 and right side rail 40 are depicted, dependent attachment of left side rail 41 is shown to comprise not only mounting plate 149, weldments 59 and 60 and shafts 147 and 148, but also mechanism 56. As is apparent by depiction of weldments 57 and 58 and mechanism 55 for right side rail 40, all components and functions of left side rail 41 are mirrored in right side rail 40. Referring again to FIG. 8, mechanism 56 comprises those elements necessary for raising, lowering or laterally translating left side rail 41. Weldments 59 and 60 are dependently cantilevered from shafts 147 and 148 in fixed position. Shafts 147 and 148 freely rotate and slide laterally within bushings 149 and 150. Bushings 149 and 150 are dependently attached to mounting plate 149 in fixed position. Pawls 152 and 153 are connected by rod 154 in such manner as to require coordinated motion of said pawls. A plurality of rectangular pegs form teeth on shafts 147 and 148 in such a manner as to form a ratchet mechanism with pawls 152 and 153. In the preferred embodiment, the said ratchet mechanism allows side rail 41 to be raised by lifting only from a lowest TRANSPORT position to either a middle LOWERED position or the upper RAISED position. In order to lower side rail 41 from the RAISED position to the LOWERED position or from the LOWERED position to the TRANSPORT position, lever 155 must be manually articulated in order to cause release of pawls 152 and 153 from the teeth of shafts 147 and 148. From the LOWERED position, side rail 41 may be freely translated laterally outward from the center of bed 29. This configuration is referred to as EXTENDED in the preferred embodiment. From the EXTENDED position, side rail 41 may be returned to the RAISED position. Side rail 41 which is in EXTENDED RAISED position must be lowered prior to translation back toward the center of bed 29, the NORMAL position. In the TRANSPORT position, side rail 41 of the preferred embodiment may be further translated toward the center of bed 29 beneath seat assembly 52 thereby reducing the overall lateral dimension of bed 29 sufficiently so as to be able to fit said bed through a standard hospital doorway. Although the excessive width of bariatric patient treatment beds has long been recognized as an undesirable characteristic for transport, prior art embodiments of bariatric patient treatment beds have failed to provide an economical, reliable and easy-to-manufacture side rail design with multiple functions and abilities for use on a bariatric bed such as bed 29.

As is well known in the art of design and manufacture of treatment beds for bariatric patients, the bariatric patient is often of such limited mobility as to make it impracticable for said patient to utilize bed function controls mounted on a side rail. Referring now to FIG. 10, there is best shown a hand held bed function control pendant 45. Pendant 45 comprises molded plastic body 198 encompassing necessary electronic hardware as is common in the industry and clip 201 held by gasket 202. Clip 201 allows the patient to attach pendant 45 to clothing or other articles increasing accessibility to pendant 45 Pendant 45 includes a plurality of push button switches 203-210 allowing the patient to control such functions as BED UP, BED DOWN, HEAD UP, HEAD DOWN, LEGS UP and LEGS DOWN as have been previously detailed. Pendant 45 attaches to either the left or right side rail 40 or 41 by cord 199 and plug 200. As will be apparent further herein, the serial communications architecture of bed 29 is interrupt driven. This architecture allows pendant 45 to be inserted in parallel with side rail controls 158 without need for further configuration.

Referring to FIG. 1, the power distribution and control structure for the preferred embodiment is shown. Each side rail 40 and 41 comprises a "Intel" 8031 type micro-controller 156 and 215, a plurality of membrane switches 156, 158, 212 and 214, LDCs 160 and 216 and pendants 45 and 213 Additionally each side rail 40 and 41 comprises attachment points 211 and 217 for parallel electrical connection of pendants 45 and 213 with membrane switches 158 and 212. Within the function box assembly 104 of bed 29 there is a "Intel" 8031 type micro-controller scale interface unit 222, a "Intel" 8031 type micro-controller solid state relay master micro-controller 220 and power interface unit 221 which serves to carry out bed function control inputs. The "Intel" 8031 type micro-controller of the solid state relay integrated circuit board 220 operates as a serial communication master controller. Board 220 communicates to slave controllers, namely to each of the "Intel" 8031 type micro-controllers 156 and 215 embedded within each side rail 40 and 41, as well as a third "Intel" 8031 type micro-controller on the scale interface unit integrated circuit board 222 The transformer assembly 103 comprises transformer 247 and main power switch 219 as well as standard power cord 218 Optional limit switches 223 may be placed on the bed as desired for safety purposes and interfaced to solid state relay board 220.

As is best shown by the flow diagram of FIG. 12, subsequent to the completion of the power-on initialization sequence of bed 29 for each of its electronic assemblies, the solid state relay board micro-controller initiates 225 a one hundred millisecond serial communications sequence 224 in a 25 millisecond timed interrupt driven process. Once every 25 ms the solid state relay board micro-controller communicates with one of its three slaves. The serial communications sequence 224 operates as a continuous loop and at the conclusion 242 of each 100 ms cycle the sequence starts again at step 225.

During the first 25 ms stage designated as step 226 of the serial communication sequence 224 data denoting left side articulation commands, left side alarm weight, left side zero weight, left side activation status, and left side exit alarm activation status is read from the RAM of the left side micro-controller unit 156 and written to the RAM of the solid state relay board 220. During the second 25 ms interrupt stage designated as step 227 of the serial communications sequence 224, data denoting right side bed articulation commands, right side alarm weight, right side zero weight, right side activation status, and right side exit alarm activation status is read from the RAM of the right side micro-controller unit 215 and written to the RAM of the solid state relay board 220. In step 228, at the beginning of the third 25 ms interrupt stage of serial communication sequence 224 the solid state relay board micro-controller unit 220 determines if the right side micro-controller unit 215 has been activated for scale functions during the present 100 ms cycle one cycle being defined as consisting of those elements shown in FIG. 12. If in step 228 it is found that the right side micro-controller unit 215 has been activated for scale functions within the present cycle, the remaining time in the third 25 ms interrupt stage is utilized by step 229 of serial communications sequence 224 to replace display of scale information on the left side rail LCD 160 with a message stating that the left side is inactive for scale functions. If in step 228 of serial communications sequence 224 it is determined that the right side micro-controller unit 215 has not been activated for scale functions within the present cycle, the solid state relay board micro-controller unit 220 then determines during step 230 of the sequence 224 if either the right side alarm weight or the right side zero weight values ascertained in step 227 of sequence 224 represent a change from the values ascertained during the 100 ms cycle immediately previous to the present 100 ms cycle. If change is indicated in step 230 of serial communications sequence 224, the newly ascertained right side values are read from the RAM from the solid state relay board micro-controller 220 and written to the RAM of the left side micro-controller unit 156 in step 231 during the time remaining in the third 25 ms interrupt stage If no change is indicated in step 230, serial communications sequence 224 continues in step 232 with a determination of the left side rail micro-controller unit 156 active/inactive status If in step 232 of serial communication sequence 224, the left side micro-controller unit 156 is found to be active for scale functions the remaining time in the third 25 ms interrupt stage is utilized in step 233 to read raw weight data from the RAM of the solid state relay board micro-controller unit 220 and write the retrieved data to the RAM of the left side micro-controller unit 156. If in step 232 of serial communication sequence 224 the left side micro-controller unit 156 is found to be inactive for scale functions, the remaining time in third 25 ms interrupt stage is utilized in step 234 of sequence 224 to read raw weight data from the RAM of the scale interface unit 222 and write the retrieved data to the RAM of the solid state relay board 220.

The fourth 25 ms interrupt stage of serial communications sequence 224 commences in step 235 with the determination of whether the left side rail micro-controller unit 156 has been activated for scale functions within the present 100 ms cycle. If in step 235 of serial communication sequence of 224 it is determine that the left side rail micro-controller unit 156 has been activated for scale functions within the present cycle, the time remaining in the fourth 25 ms interrupt stage is utilized in step 236 to replace display of scale information on the right side rail LCD 216 by a message stating that the right side is inactive for scale functions. If in step 235 it is determined that the left side rail micro-controller unit 156 has not been recently activated for scale functions, communications sequence 224 continues in step 237 with determination of whether either the left side alarm weight or left side zero weight values ascertained in step 226 of sequence 224 represents change from the values ascertained during the 100 ms cycle immediately previous to the present 100 ms cycle.

If change is indicated in step 237 of serial communications sequence 224, the newly ascertained left side values are read from the RAM of the solid state relay board 220 and written to the RAM of the right side micro-controller unit 215 in step 238 during the time remaining in the fourth 25 ms interrupt stage. If no change is indicated in step 237, serial communications sequence 224 continues in step 239 with determination of whether the right side rail micro-controller unit 215 is active or inactive for scale functions. If during step 239 of serial communications sequence 224 it is determined the right side micro-controller unit 215 is active for scale functions the sequence 224 continues in step 156 by utilizing the remaining time of the fourth 25 ms interrupt stage to read raw weight data from the RAM of the solid state relay board micro-controller unit 220 and write the retrieved data to the RAM of right side micro-controller unit 215. If in step of 239 of sequence 224 it is determined that the right side micro-controller unit 215 is not active for scale functions, the time remaining in the fourth 25 ms interrupt stage is utilized in step 241 of sequence 224 to read raw weight data from the RAM of the scale interface unit 220 and write the retrieved data to the RAM of the solid state relay board micro-controller unit 220. The sequence then repeats 242 commencing at step 225.

It is also notable that the foregoing description primarily describes an embodiment that is substantially the same as a product which is commercially available under the designation "BariKare" Bed This bed, which is in essence bed 29, has an overall length of 87.5 inches, a height variable between 21 25 to 27.5" from the floor to the hard pan surface of the seat section, a mattress 11 measuring 80" L by 36" W by 5" thick, a caster diameter of 5", siderail height of 21.5', siderail length of 48", and overall bed weight of roughly 665 pounds. The width of such bed varies depending on which position the siderails are in −40.25" with the siderails in the transport position, 43.25" with the siderails in the normal position and 54" with the siderails in the extended position. The same dimensions are applicable to the above-described bed 29. As of filing of this application, such "BariKare" Bed is available through Kinetic Concepts, Inc. of San Antonio, Tex. Accordingly, reference to such commercially available bed and/or its accompanying descriptive information may provide even further understanding of the finer points of the preferred embodiments.

Although the present inventions have been described in terms of the foregoing embodiments, this description has been provided by way of example only and is not to be construed as a limitation on the invention, the scope of which is only limited by the following claims. Those skilled in the art will recognize that many variations, alternations, modifications, substitutions and the like are ready possible to the above-described embodiments. Only a partial sampling of such variations have been pointed out herein.

I claim:

1. A bariatric bed, comprising:

a hospital bed frame of a bariatric type, the frame having a strength to regularly support patients weighing in excess of 500 pounds, wherein the frame includes:

a sectioned articulatable mattress support to support a mattress; and a drive to articulate the mattress support to raise and lower a head section thereof relative to a seat section, the drive having strength to regularly raise and lower the head section relative the seat section while patients weighing in excess of 500 pounds are positioned on the mattress supported by the mattress support; and a side rail moveably coupled to a support member, wherein the support member is configured such that the side rail can be placed in a lowered position at a normal width and the side rail can be placed in a lowered position at an extended width;

wherein the support member is configured such that the side rail can be raised from the lowered position to an operative position at the normal width and such that the side rail can be raised from the lowered position to an operative position at the extended width; and wherein the side rail is maintained in a substantially vertical position while the side rail is in the lowered position and while the side rail is in the operative position.

2. The bariatric bed of claim 1, wherein the support member includes a mattress extension removeably positioned on a surface of the support member proximal to the seat section of the mattress.

3. The bariatric bed of claim 2, wherein the support member is configured such that the side rail cannot be moved from the operative position at the normal width to the operative position at the extended width without lowering the side rail to the lowered position.

4. The bariatric bed of claim 2, wherein the support member is operable to slide laterally away from a center of the bariatric bed to increase the width of the bariatric bed and to provide a surface on which the removeable cushion is positioned.

5. The bariatric bed of claim 1, wherein the support member includes a left support member coupled to a left side rail and a right support member coupled to a right side rail, and wherein the width of the bariatric bed is approximately 43.25 inches when the left and right side rail are at the normal width and wherein the width of the bariatric bed is approximately 54 inches when the left and right side rail are at the extended width.

6. The bariatric bed of claim 1, wherein the support member is configured to lock the side rail in the operative position.

7. The bariatric bed of claim 6, wherein the support assembly is configured to lower the entire side rail from the lowered position to a transport position.

8. The bariatric bed of claim 1, wherein the sectioned articulatable mattress support includes a first, a second, and a third articulatable section, each articulatable section to support a leg region, a seat region, and a head region, respectively, of the mattress supported on the sectioned articulatable mattress support.

9. The bariatric bed of claim 1, wherein the support member includes a shaft slidably positioned at least partially within a bushing, wherein the shaft can slide laterally away from the mattress support to move the side rail from the normal width to the extended width, and wherein the shaft can slide laterally towards the mattress support to move the side rail from the normal width to a transport width.

10. The bariatric bed of claim 1, wherein the support member includes a shaft that is slidably and rotatably positioned at least partially within a bushing.

11. A bariatric bed having a frame to support a patient support surface, wherein the bariatric bed comprises:

an articulation mechanism to articulate the patient support surface between a relatively flat planar position and a multi-planar position;

a support member slidably coupled to the bariatric bed proximal the articulation mechanism; and a side rail moveably coupled to the support member, the side rail configured to be raised from a lowered position to an operative position relative to the support member, the support member slidable while the side rail is in the lowered position to slide the side rail in its entirety laterally relative to the patient support surface to adjust a width of the patient support surface, and wherein the side rail is configured to be lowered from the lowered position to a transport position.

12. The bariatric bed of claim 11, wherein the slide rail can be raised from the lowered position when the support member is in an inner position;

wherein the slide rail can be raised from the lowered position when the support member is in an extended position; and wherein the extended position is farther away from the center of the bed than the inner position.

13. The bariatric bed of claim 12, wherein the support member includes left and right support members and the side rail includes left and right side rails;

wherein the left and right said rails can be positioned in an inner position in the operative position;

wherein the side rails can be positioned in an extended position in the operative position; and wherein the width of the bariatric bed is approximately 43.25 inches when the left and right side rail are in the inner position and wherein the width of the bariatric bed is approximately 54 inches when the left and right side rail are in the extended position.

14. The bariatric bed of claim 13, wherein the patient support surface includes a mattress and a mattress extension, the articulation mechanism to support the mattress and the left and right support members to support the mattress extension.

15. The bariatric bed of claim 11, wherein the patient support surface includes a mattress and a mattress extension, the mattress positioned on the articulation mechanism and the mattress extension positioned on the support member.

16. A bariatric bed, comprising:

a frame of a bariatric type, the frame having a strength to regularly support a patient weighing in excess of 500 pounds, the frame including:

an articulation mechanism to articulate a patient support surface positioned on the articulation mechanism from a generally horizontal planar configuration to a multi-planar configuration;

a left adjustment mechanism coupled to the bariatric bed and coupled to a left side rail, wherein the left adjustment mechanism is configured to raise the left side rail from a lowered inner position to an operative inner position and wherein the left adjustment mechanism is configured to raise the left side rail from a lowered extended position to an operative extended position;

a right adjustment mechanism coupled to the bariatric bed and coupled to the right side rail, wherein the right adjustment mechanism is configured to raise the right side rail from a lowered inner position to an operative inner position and wherein the right adjustment mechanism is configured to raise the right side rail from a lowered extended position to an operative extended position.

17. The bariatric bed of claim 16, wherein the left and the right adjustment mechanisms are configured to support an extension of the patient support surface, the extension including removeable cushions, the patient support surface including a removable mattress.

18. The bariatric bed of claim 17, wherein the left and the right adjustment mechanism each include a shaft with teeth configured to engage a pawl to form a ratchet mechanism.

19. The bariatric bed of claim 18, wherein the left and the right side rail moveably coupled to the left and right support member each independently rotate relative to the left and right adjustment mechanism to raise and lower the left and right side rail relative to the left and right adjustment mechanism.

20. The bariatric bed of claim 16, wherein the articulation mechanism includes a radioluscent head assembly having a mechanism for holding an X-ray cassette.

* * * * *